US009730523B2

(12) United States Patent
Bartelsmeyer et al.

(10) Patent No.: US 9,730,523 B2
(45) Date of Patent: Aug. 15, 2017

(54) FOLDABLE COMPOSITE BED FRAME

(71) Applicant: L&P Property Management Company, South Gate, CA (US)

(72) Inventors: Robert A. Bartelsmeyer, High Point, NC (US); John J. Case, Plymouth, MI (US); Philip E. Herrin, Bremen, GA (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 15/188,112

(22) Filed: Jun. 21, 2016

(65) Prior Publication Data

US 2017/0013968 A1 Jan. 19, 2017

Related U.S. Application Data

(60) Provisional application No. 62/192,227, filed on Jul. 14, 2015.

(51) Int. Cl.
*A47C 19/04* (2006.01)
*A47C 19/12* (2006.01)

(52) U.S. Cl.
CPC ..... *A47C 19/04* (2013.01); *A47C 19/12* (2013.01)

(58) Field of Classification Search
CPC ..... A47C 19/00; A47C 19/02; A47C 19/04; A47C 19/12
See application file for complete search history.

(56) References Cited

U.S. PATENT DOCUMENTS 3,646,623 A * 3/1972 Harris ..... A47C 19/04 248/408
3,657,748 A * 4/1972 Weinhart ..... A47C 23/062 5/238
4,038,710 A * 8/1977 Tambascio ..... A47C 19/04 5/181
4,263,683 A 4/1981 Knoke
5,471,809 A * 12/1995 Frankel ..... E04C 3/29 138/114
5,740,568 A 4/1998 Elliott
6,826,790 B1 * 12/2004 Polevoy ..... A47C 19/024 248/345.1
7,100,228 B2 * 9/2006 Polevoy ..... A47C 19/024 5/424
7,213,379 B2 * 5/2007 Carlson ..... E04C 3/29 52/837
7,219,378 B2 5/2007 Polevoy et al.
7,363,664 B2 * 4/2008 Polevoy ..... A47C 19/005 5/132
7,954,184 B2 6/2011 Polevoy et al.
(Continued)

*Primary Examiner* — David E Sosnowski
*Assistant Examiner* — Rahib Zaman
(74) *Attorney, Agent, or Firm* — Wood, Herron & Evans, LLP

(57) ABSTRACT

A bed frame which can be assembled without the use of additional tools and may be collapsed for shipping. The bed frame comprises a pair of side rails, three cross rail assemblies and mounting brackets. Each of the cross rail assemblies is adjustable in length and comprises multiple movable members. Each cross rail member has a projection which fits inside a cavity of a leg assembly secured to one of the side rails. To disassemble the bed frame, the cross rail assemblies may be removed from the side rails without any tools.

20 Claims, 19 Drawing Sheets

(56) References Cited

U.S. PATENT DOCUMENTS

| | | | | |
|---|---|---|---|---|
| 8,832,876 | B1 * | 9/2014 | Oh | A47C 17/64<br>5/116 |
| 8,832,881 | B2 * | 9/2014 | Polevoy | A47C 19/021<br>362/130 |
| 9,439,514 | B2 | 9/2016 | Polevoy et al. | |
| 2003/0200608 | A1 * | 10/2003 | Polevoy | A47C 19/005<br>5/201 |
| 2007/0044235 | A1 * | 3/2007 | Navarro | A47C 19/005<br>5/201 |
| 2007/0074344 | A1 * | 4/2007 | Cloer | A47C 19/025<br>5/310 |
| 2008/0155799 | A1 * | 7/2008 | Bartelsmeyer | A47C 19/005<br>24/457 |
| 2009/0188036 | A1 * | 7/2009 | Bartelsmeyer | A47C 19/128<br>5/11 |
| 2010/0242171 | A1 * | 9/2010 | Polevoy | A47C 19/005<br>5/282.1 |
| 2011/0289682 | A1 * | 12/2011 | Lee | A47C 19/126<br>5/202 |
| 2014/0208506 | A1 * | 7/2014 | Bartelsmeyer | A47C 19/005<br>5/400 |
| 2015/0047123 | A1 | 2/2015 | Polevoy et al. | |
| 2017/0013968 | A1 * | 1/2017 | Bartelsmeyer | A47C 19/12 |

* cited by examiner

FOLDABLE COMPOSITE BED FRAME

CROSS REFERENCE TO RELATED APPLICATIONS

This application claims the benefit of U.S. Provisional Patent Application Ser. No. 62/192,227 filed Jul. 14, 2015, which is fully incorporated by reference herein.

FIELD OF THE INVENTION

This invention relates generally to bed frames and, more particularly, to a bed frame that is capable of being shipped in a smaller container than a standard bed frame.

BACKGROUND OF THE INVENTION

A conventional bed frame has two opposed side rails with a plurality of cross support members, or slats, extending across the side rails for supporting a box spring or bedding foundation. Each side rail is typically formed from an elongated piece of metal having an L-shaped cross-section. Thus, each side rail typically includes a horizontal flange for supporting a portion of the box spring and a vertical flange to help prevent deflection of the side rail under the weight of the box spring, mattress, and any person lying on the mattress. Although such angular arrangement provides structural integrity, each side rail terminates in a sharp lower corner that may cause injury to the ankle or skin of a person making the bed or moving around the bed.

Conventional bed frames may further include several other components. For example, metal support leg assemblies are usually secured to the side rails or cross members to support the bed frame about the floor. Oftentimes, the support leg assemblies are positioned inwardly from the side rails to avoid a person making the bed or moving around the bed from striking his or her foot on one of the metal support leg assemblies and injuring the foot. Also, mounting brackets are typically provided at one or both ends of each side rail to mount the bed frame to a headboard or footboard.

In order to facilitate transportation and assembly, the components of a conventional bed frame are typically shipped in a cardboard box and assembled on site. Due to the length of the side rails of the bed frame, such a shipping container may exceed the size limits of shipping companies. Therefore, the shipping company may charge one or more additional fees to ship such a long container. Another disadvantage of a long packaged bed frame is that the shipping container may not fit inside a small vehicle.

Additionally, due to the exposed metal of the bed frame, one or more of the bed frame components may make its way through the cardboard of the shipping package and get lost or damaged.

Thus, there is a need for a bed frame which may be partially collapsed so it may be packaged into a shorter container than standard bed frames. The shorter container will avoid additional shipping fees and allow the container to be transported in small vehicles.

There is further a need for a bed frame which may be disassembled and does not have exposed metal so as to avoid damage to the package or bed frame.

SUMMARY OF THE INVENTION

This invention comprises a bed frame assembly comprising a pair of collapsible side rail assemblies, cross rail assemblies extending between the side rail assemblies, leg assemblies secured to each side rail assembly and mounting brackets. The cross rail assemblies may be adjusted in length to fit standard bed sizes in the industry such as full, queen, California king and king.

Each of the collapsible side rail assemblies comprises two side rail sections. Each side rail section is secured to a center leg assembly, such that the side rail sections may pivot relative to the center leg assembly. Each side rail section comprises a straight member having a hollow metal core covered with a plastic coating and an outer leg assembly secured to one end of the side rail section. A mounting bracket may be secured to either end of the straight member of each side rail section for securing a headboard or a footboard to the side rail assembly.

Each leg assembly of each side rail assembly comprises multiple pieces, including one piece having a cavity therein. The cavity is sized to receive one of the projections of one of the cross rail assemblies. In one embodiment, the cavity is generally T-shaped along with the projection located at the end of one of the cross rails.

The bed frame assembly further comprises multiple cross rail assemblies extending between the leg assemblies of the side rail assemblies. In the preferred embodiment, the bed frame assembly has three cross rail assemblies. However, any number of cross rail assemblies in accordance with the present invention may be used, provided enough leg assemblies are provided. Each cross rail assembly comprises two cross rails movable relative to each other to adjust the cross rail assembly to one of multiple predetermined lengths. In one embodiment, the cross rail assemblies may be adjusted to one of four predetermined lengths corresponding to the widths of standard beds in the industry including full, queen, California king and king. Each of the cross rails of each of the cross rail assemblies has a projection sized to fit into one of the cavities of one of the leg assemblies.

According to another aspect of this invention, the collapsible bed frame assembly comprises two side rail assemblies. Each of the side rail assemblies comprises two side rail sections. Each side rail section is hinged to a center leg assembly and secured to an outer leg assembly. Each leg assembly of each side rail section has a cavity therein.

The collapsible bed frame assembly further comprises multiple cross rail assemblies extending between the side rail assemblies. Each cross rail assembly comprises two cross rails movable relative to each other to adjust the cross rail assembly to one of multiple predetermined lengths. Each of the cross rails comprises a projection sized to fit into one of the cavities of one of the leg assemblies, an inner leg and a middle member extending between the projection and inner leg. The middle member comprises a hollow metal member. A portion of each cross member passes through the inner leg of the other cross member.

DETAILED DESCRIPTION OF THE DRAWINGS

Figure 1:
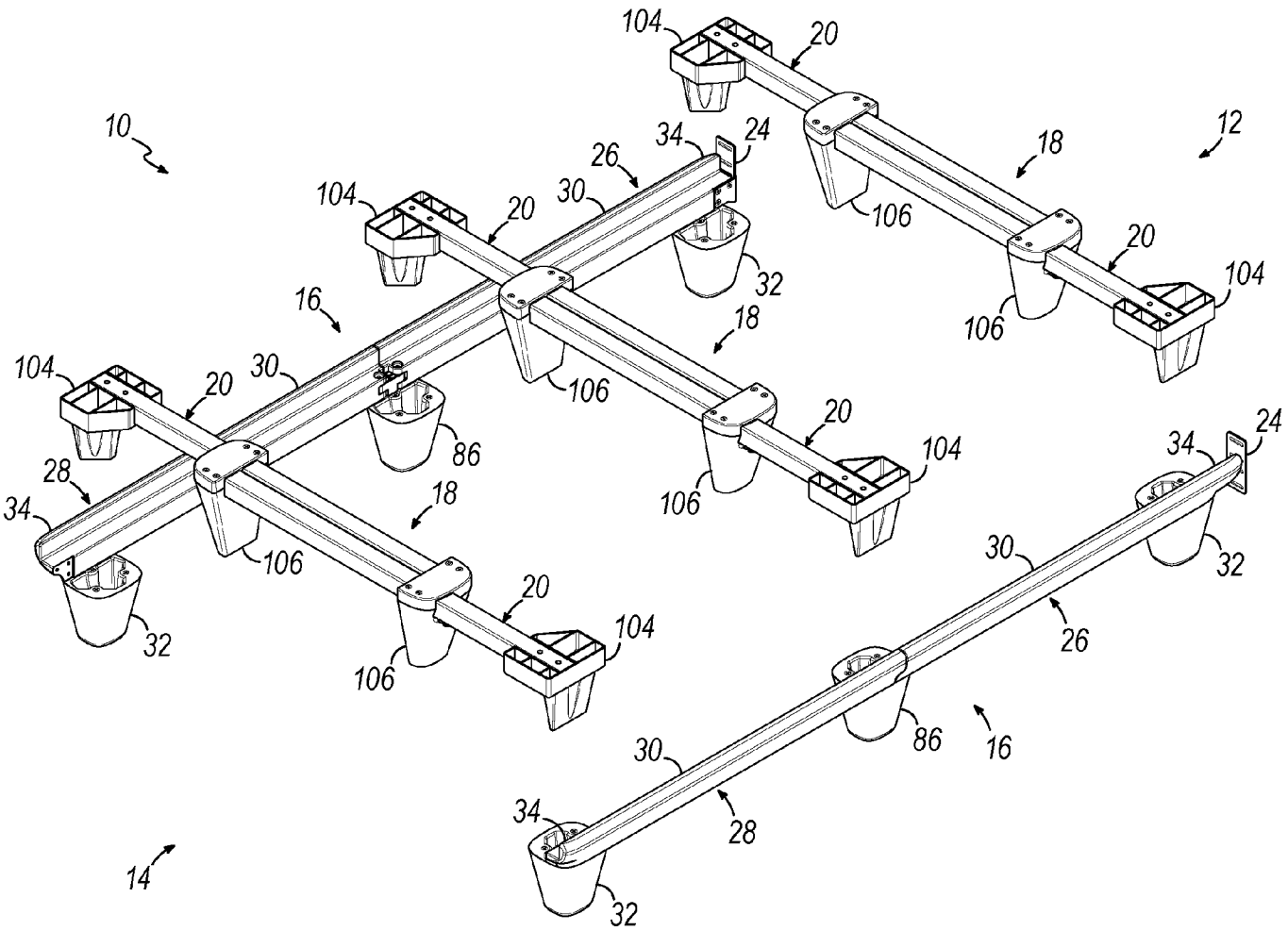
FIG. 1 is a perspective view of the bed frame assembly in a partially disassembled condition.

Referring to the drawings, and particularly to FIG. 1, there is illustrated a bed frame assembly 10 prior to assembly. The bed frame assembly 10 has a head end 12 and a foot end 14. The bed frame assembly 10 comprises two collapsible side rail assemblies 16 and three collapsible cross rail assemblies 18, including a first cross rail assembly 18 at the head end 12 of the bed frame assembly 10, a second or center cross rail assembly 18 and a third cross rail assembly 18 at the foot end 14 of the bed frame assembly 10. Each of the cross rail assemblies 18 is identical. However, it is within the contemplation of the inventors that one or more of the cross rail assemblies may be slightly different than the others. Each side rail assembly 16 includes a mounting bracket 24 at the head end 12 for securing the bed frame assembly 10 to a headboard (not shown).

Figure 2:
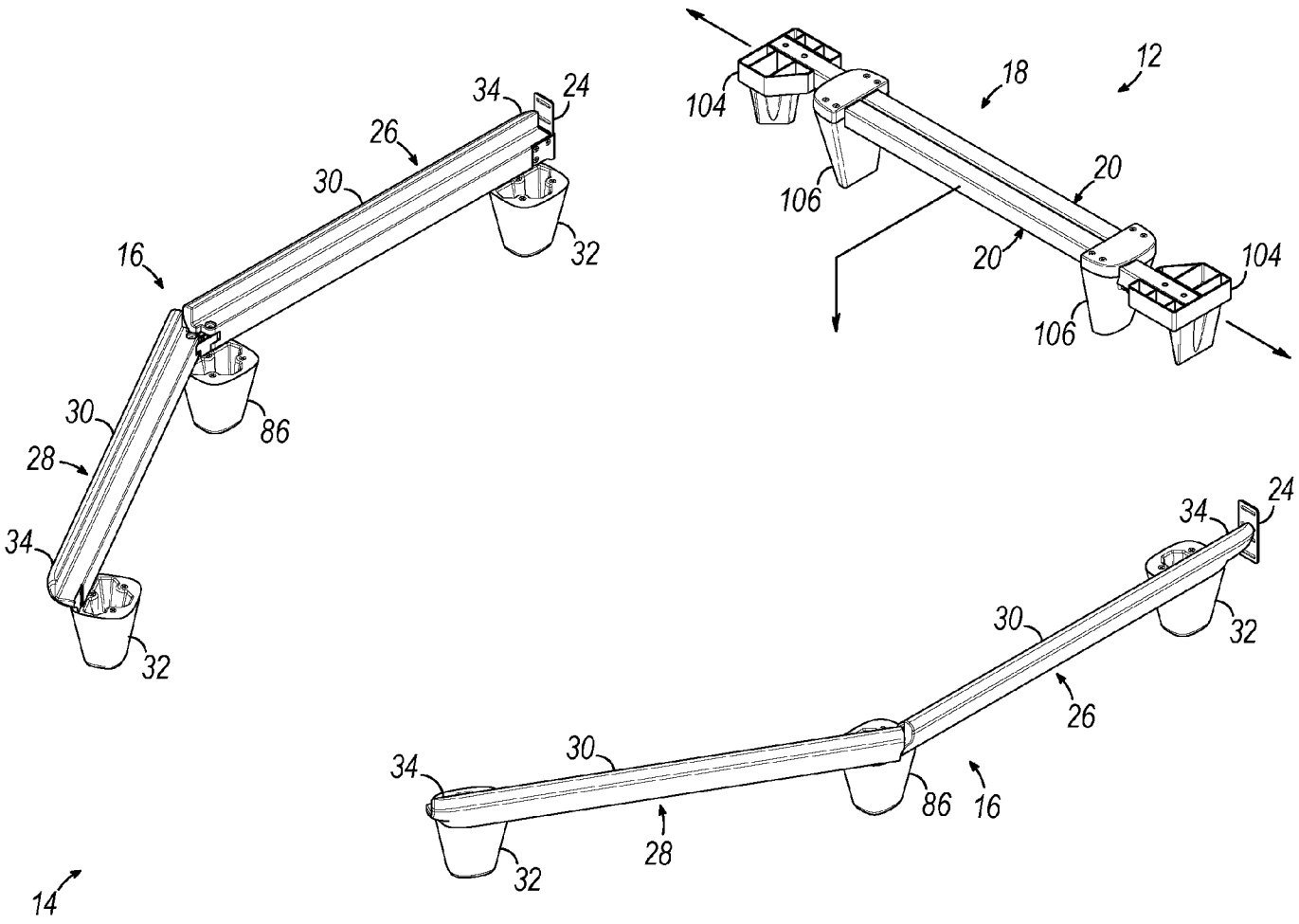
FIG. 2 is a perspective view of one of the cross rail assemblies being expended and being joined to the side rail assemblies.
Figure 2A:
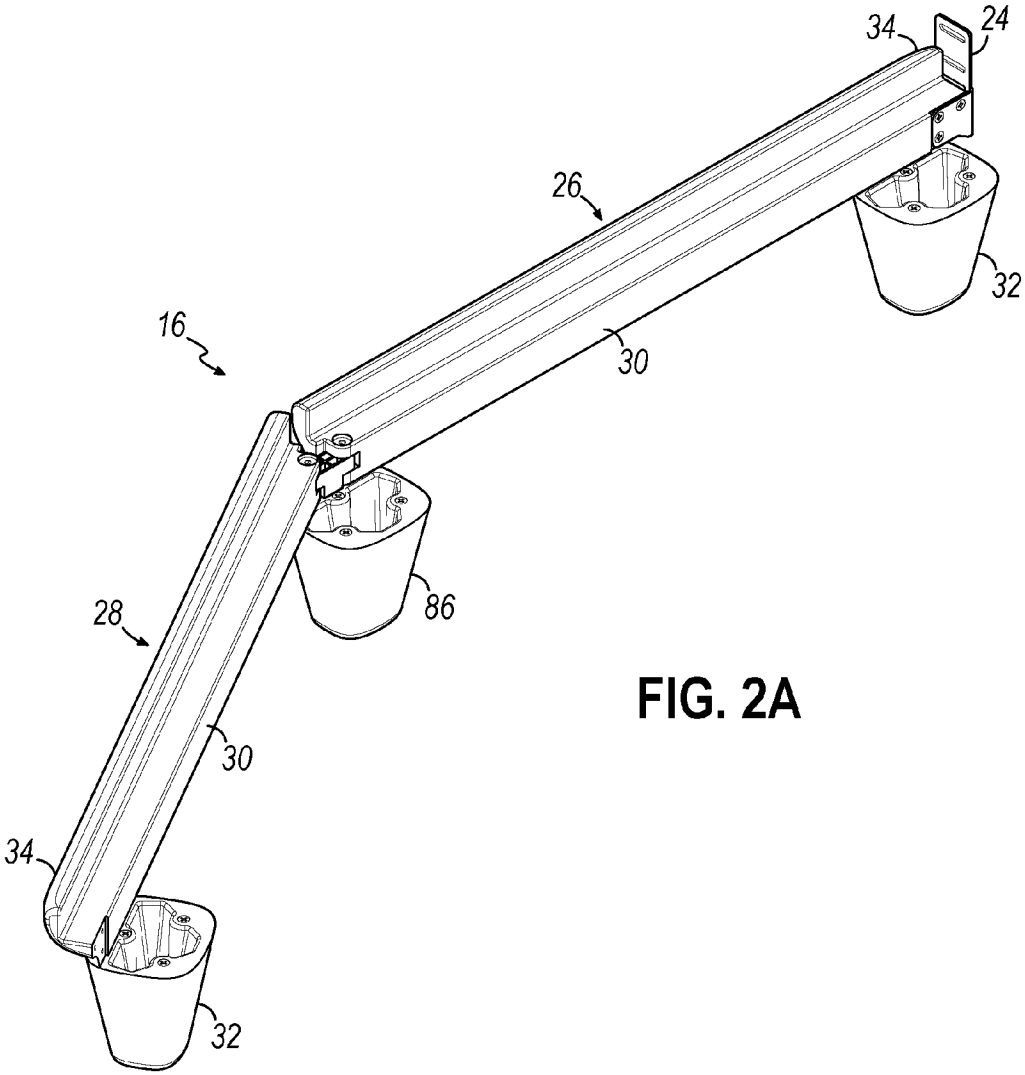
FIG. 2A is an enlarged view of one of the side rail assemblies of the bed frame assembly of FIG. 1 in a partially collapsed condition.

As best shown in FIGS. 2 and 2A, each of the collapsible side rail assemblies 16 comprises two side rail sections: a head side rail section 26 and a foot side rail section 28. Each side rail section 26, 28 comprises a linear or straight body portion 30 and an outer leg assembly 32 secured to one end 34 of the linear or straight body portion 30 in any known manner, such as fasteners. As shown in FIG. 2C, proximate its end 34, the straight body portion 30 of each side rail section 26, 28 has a flattened portion 36 with threaded openings 38 adapted to receive fasteners 40. In order to secure the mounting bracket 24 to the straight body portion 30 of the side rail head section 26 (or foot section 28), a flange 42 of the mounting bracket 24 is placed against the flattened portion 36 and fasteners 40 are passed through openings 44 in the flange 42 and into the threaded openings 38. Although the drawings show a mounting bracket 24 secured to the end 34 of each head side rail section 26, the mounting bracket 24 may be omitted. Alternatively, another mounting bracket (not shown) may be secured to the end 34 of the foot side rail section 28 for mounting the bed frame to a footboard (not shown).

As shown in FIG. 2C, the linear or straight body portion 30 of each side rail section 26, 28 comprises a metal core member 46 having a generally rectangular cross-section defining a hollow interior 48. As shown in FIG. 2C, the hollow core member 46 has a top 50, bottom 52 and two sides 54. The hollow core member 46 is surrounded with a plastic coating or covering 56, including an outer plastic wall 58 containing strengthening ribs 60. The outer plastic wall 58 provides a stop to prevent lateral movement of a box spring sitting on top of the side rail assemblies 16 and, more particularly, on top of the coated hollow core member 46. See FIGS. 5 and 6.

Figure 5:
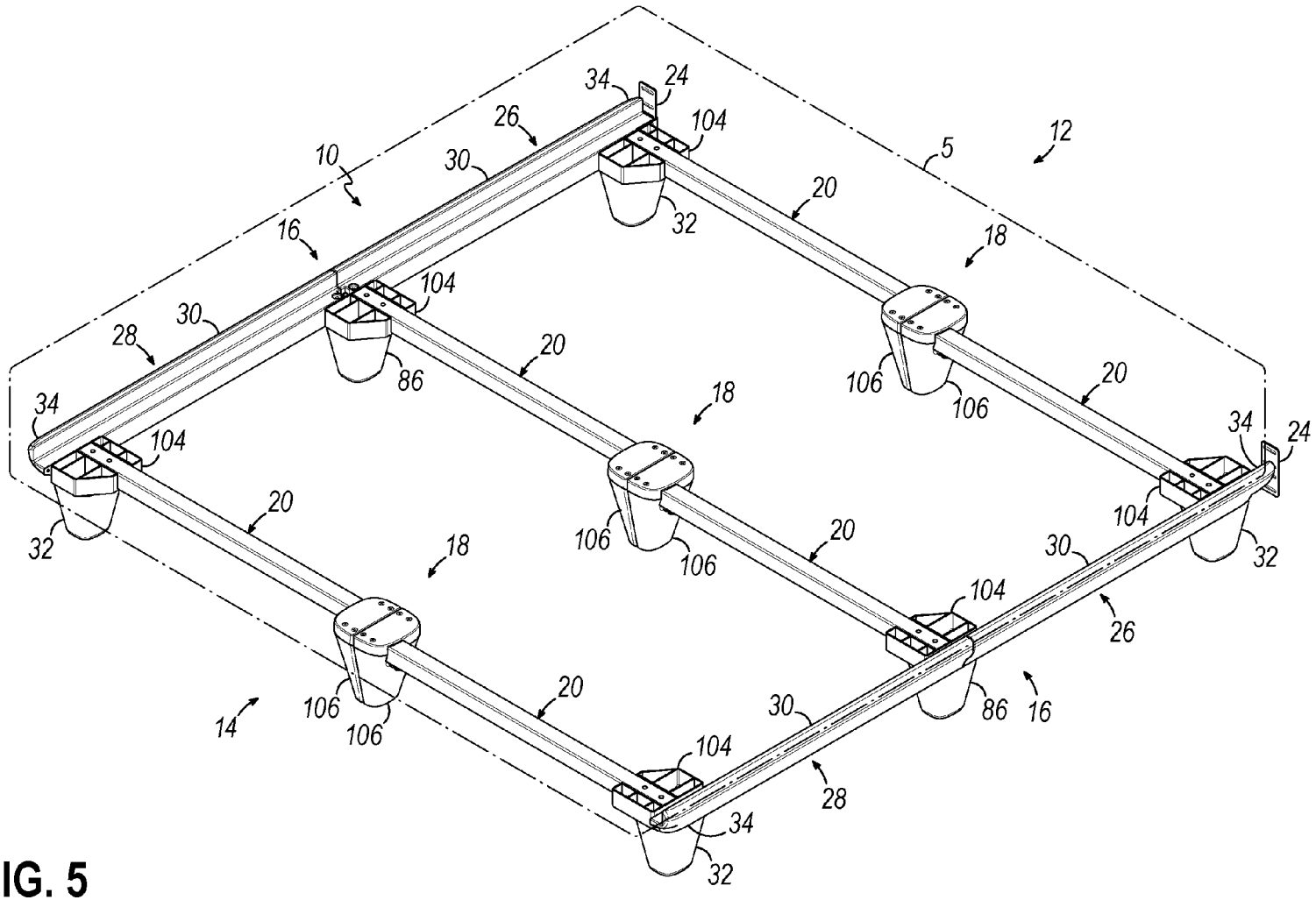
FIG. 5 is a perspective view of the bed frame assembly showing all three cross rail assemblies in a fully expanded position and locked to fit a king size box spring.

As shown in FIG. 2C, the outer leg assembly 32 secured to one end 34 of the straight body portion 30 of the head side rail assembly section 26 comprises a molded plastic outer leg section 62 and a molded plastic inner leg section 64. The outer and inner leg sections 62, 64, respectively, of each outer leg assembly 32, are secured together with fasteners 66. The molded plastic outer leg section 62 has a smooth outer surface 68 and a receptacle 70. As shown in FIG. 2C, the molded plastic inner leg section 64 has an upper lip 72 through which are located three holes 74. Fasteners 66 pass through the holes 74 of upper lip 72 before being secured inside threaded openings 76 of the molded plastic outer leg section 62. The molded plastic inner leg section 64 also has an outer wall 80 and bottom 82 defining a generally T-shaped bucket 78 extending downwardly from the upper lip 72 and a hollow interior cavity 84. The size of the generally T-shaped bucket 78 is slightly smaller, but similarly shaped so it fits inside the receptacle 70 of the molded plastic outer leg section 62 when the outer and inner leg sections 62, 64, respectively, of each outer leg assembly 32 are secured together. Although three fasteners are illustrated securing the outer and inner leg sections 62, 64 of outer leg assembly 32 together, any number of fasteners may be used. One purpose of the shape of the generally T-shaped buckets 78 of the inner leg sections 64 and the shape of the projections 120 of the end members 104 of the cross rail assemblies 18 is that when the projections 120 are inside the buckets 78 of the inner leg sections 64, the cross rail assembly 18 is maintained in an orientation generally perpendicular to the side rail assemblies 16, as shown in FIG. 5. This is true for each cross rail assembly 18.

Figure 2B:
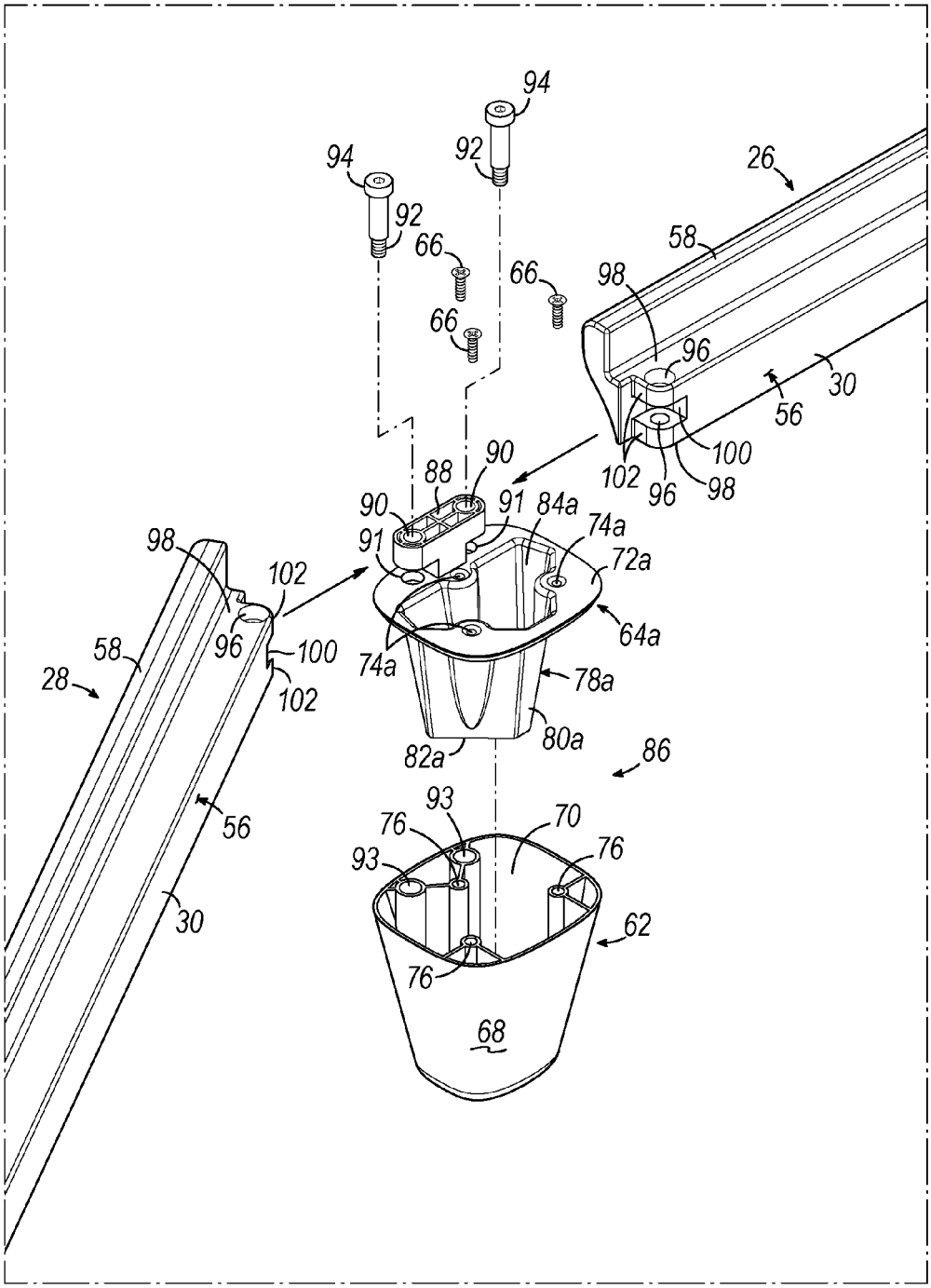
FIG. 2B is an enlarged perspective view of the center leg assembly and hinge of the side rail of FIG. 2A.
Figure 2C:
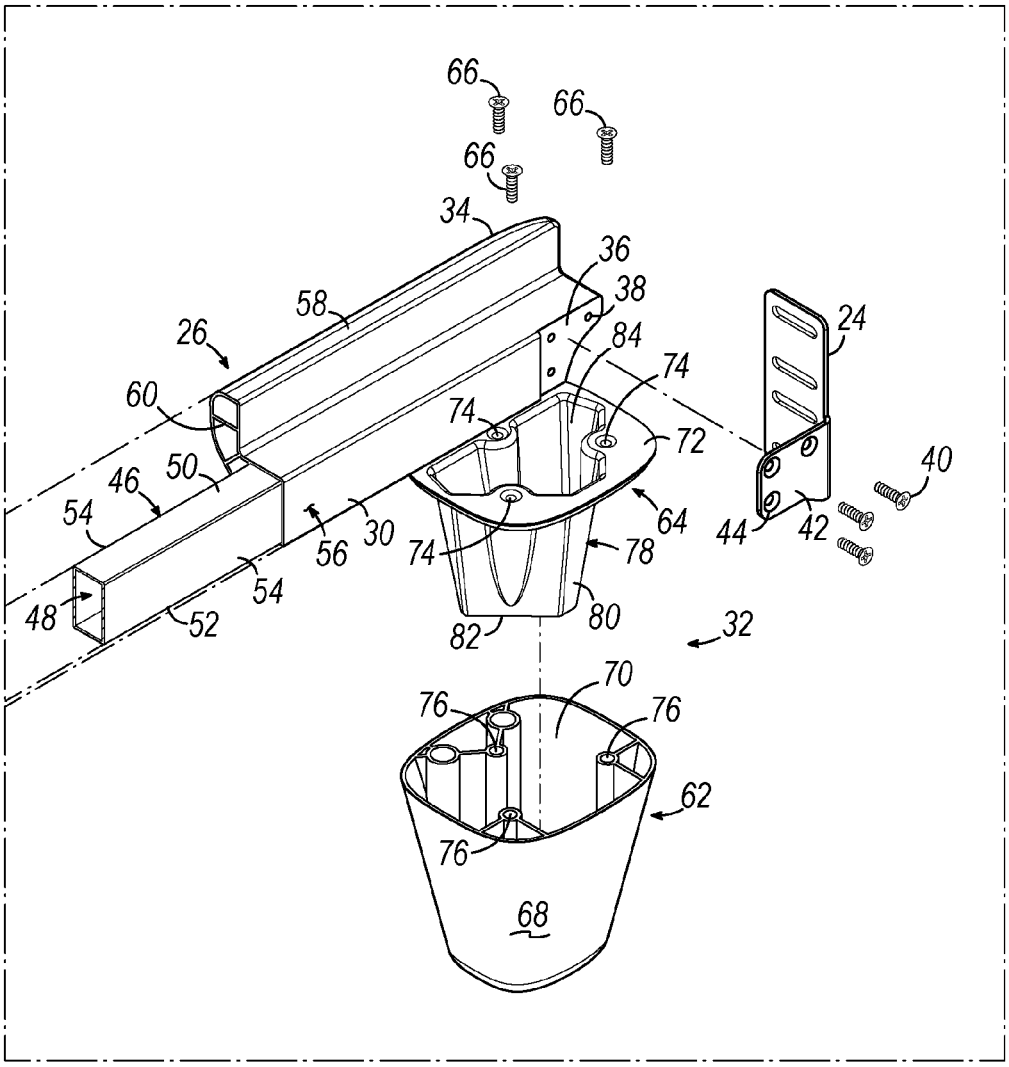
FIG. 2C is an enlarged perspective view of an outer leg assembly of the side rail assembly of FIG. 2A showing a mounting bracket.

As best shown in FIGS. 2 and 2B, each of the collapsible side rail assemblies 16 further comprises a center leg assembly 86. As best shown in FIG. 2B, the center leg assembly 86 comprises the same molded plastic outer leg section 62 as each of the outer leg assemblies 32. The center leg assembly 86 further comprises a molded plastic inner leg section 64*a* which is similar, but not identical, to the plastic inner leg section 64 of each of the outer leg assemblies 32, one being shown in FIG. 2C. For simplicity, like parts have like numbers, but with an "a" designation.

The molded plastic inner leg section 64*a* of center leg assembly 86 has an upper lip 72*a* through which are located three holes 74*a* and two openings 91. Fasteners 66 pass through the holes 74*a* of upper lip 72*a* before being secured inside threaded regions 76 of the molded plastic outer leg section 62. The molded plastic inner leg section 64*a* also has an outer wall 80*a* and bottom 82*a* defining a generally T-shaped bucket 78*a* extending downwardly from the upper lip 72*a* and a hollow interior cavity 84*a*. The size of the generally T-shaped bucket 78*a* is slightly smaller, but similarly shaped, so it fits inside the receptacle 70 of the molded plastic outer leg section 62 when the outer and inner leg sections 62, 64*a*, respectively, of each center leg assembly 86 are secured together. Although three fasteners are illustrated securing the outer and inner leg sections 62, 64*a* of center leg assembly 86 together, any number of fasteners may be used.

As best shown in FIG. 2B, the molded plastic inner leg section 64*a* of center leg assembly 86 further comprises a generally T-shaped connector 88 integrally formed with the molded plastic inner leg section 64*a* of center leg assembly 86. However, it is within the contemplation of the present invention that the generally T-shaped connector 88 be a separate piece connected to the molded plastic inner leg section 64*a* of center leg assembly 86. The generally T-shaped connector 88 has two openings 90, each being adapted to allow a fastener 94 to pass through, as shown in FIG. 2B. As best shown in FIG. 2B, each fastener 94 passes through two openings 96 in an end portion 98 of a straight body portion 30 of one of the side rail assembly sections 26, 28. As best shown in FIG. 2B, each end portion 98 comprises a gap 100 between two lips 102, each lip 102 having one of the openings 96 therethrough. A threaded end 92 of each fastener 94 passes through one of the openings 96, one of the openings 90 and one of the openings 91, and is received in a threaded opening 93 in the molded plastic outer leg section 62. After assembly, a portion of the generally T-shaped connector 88 fits inside each of the gaps 100 of each of the end portions 98 of each of the side rail assembly sections 26, 28 and is held therein by the one of the fasteners 94, as best shown in FIG. 2A. Each fastener 94 defines a pivot axis about which the side rail sections 26, 28 pivots when the side rail assembly is collapsed.

Figure 7A:
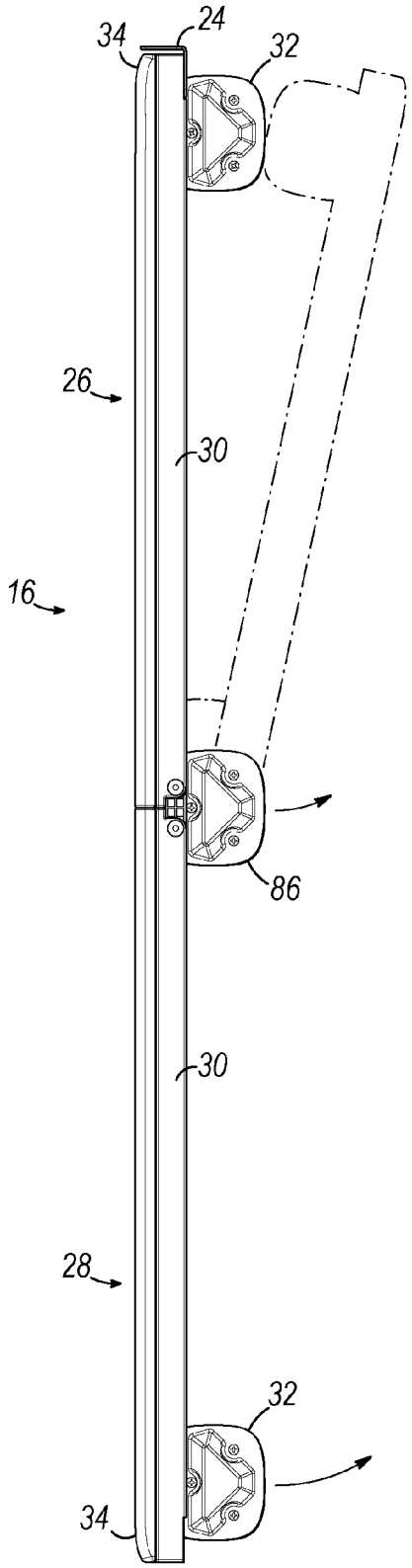
FIG. 7A is a side elevational view of one of the side rails of the bed frame in an open position.
Figure 7B:
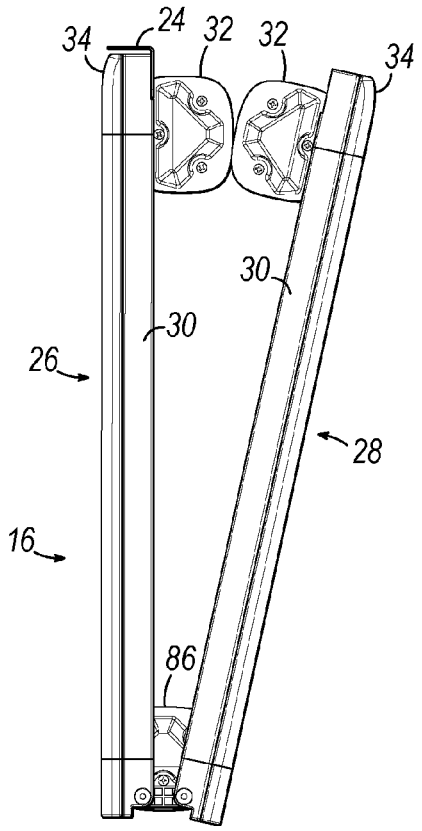
FIG. 7B is a side elevational view of one of the side rails of the bed frame in a closed position.

FIG. 2 illustrates each of the collapsible side rail assemblies 16 being unfolded or moved from a collapsed position shown in FIG. 7B to a straight position shown in FIG. 7A. In the partially unfolded position shown in FIG. 2, the head side rail section 26 and a foot side rail section 28 are angled relative to each other, and the fasteners 94 are secured inside the threaded openings 93 of the molded plastic outer leg section 62. Each of the outer leg assemblies 32 is secured in its proper location. FIG. 2A illustrates one of the collapsible side rail assemblies 16 being unfolded or moved from a collapsed position shown in FIG. 7B to a straight position shown in FIG. 7A.

Figure 2D:
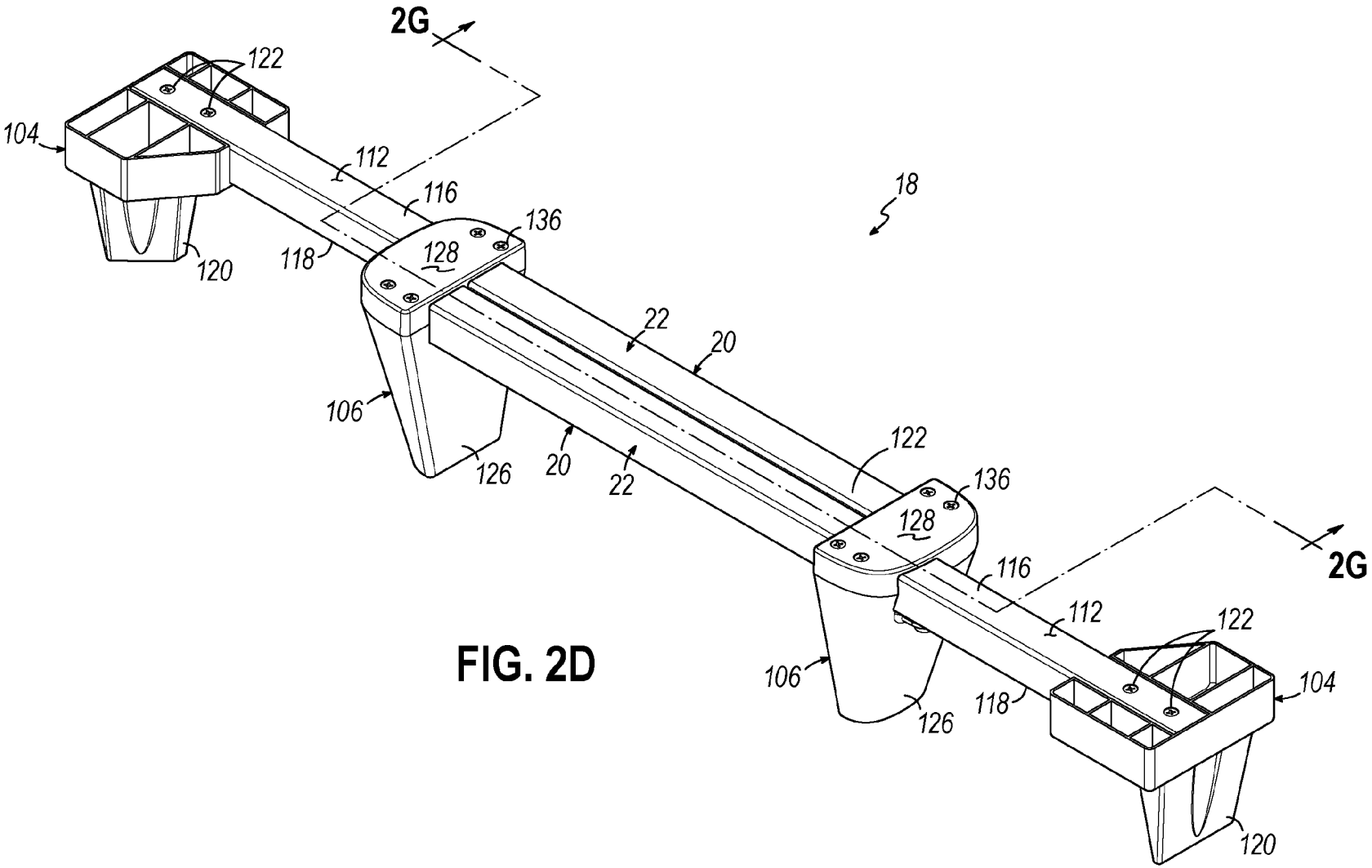
FIG. 2D is an enlarged perspective view of one of the cross rail assemblies locked in a position to receive a full size box spring.
Figure 2E:
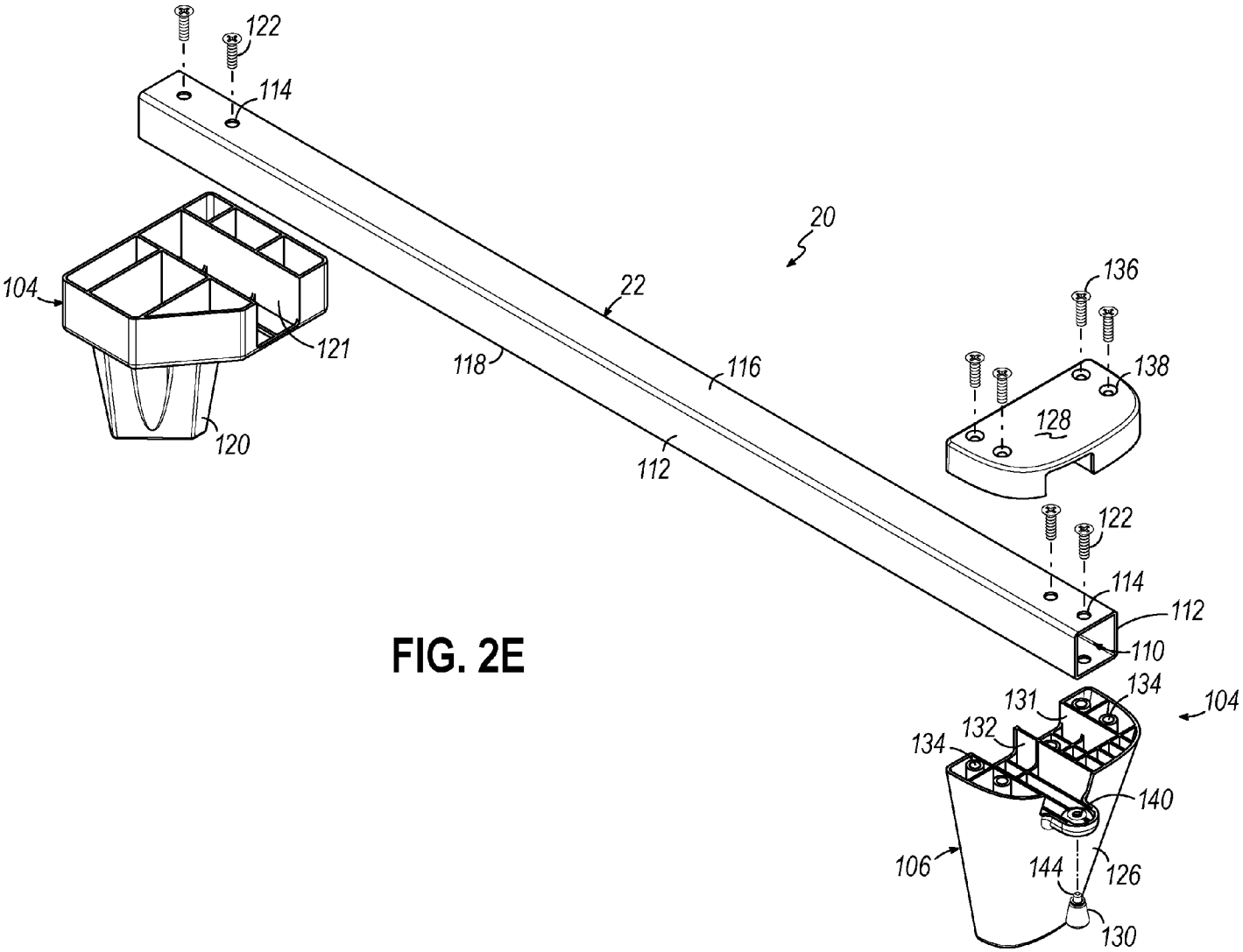
FIG. 2E is a disassembled view of a portion of a cross rail of the cross rail assembly of FIG. 2D.
Figure 2F:
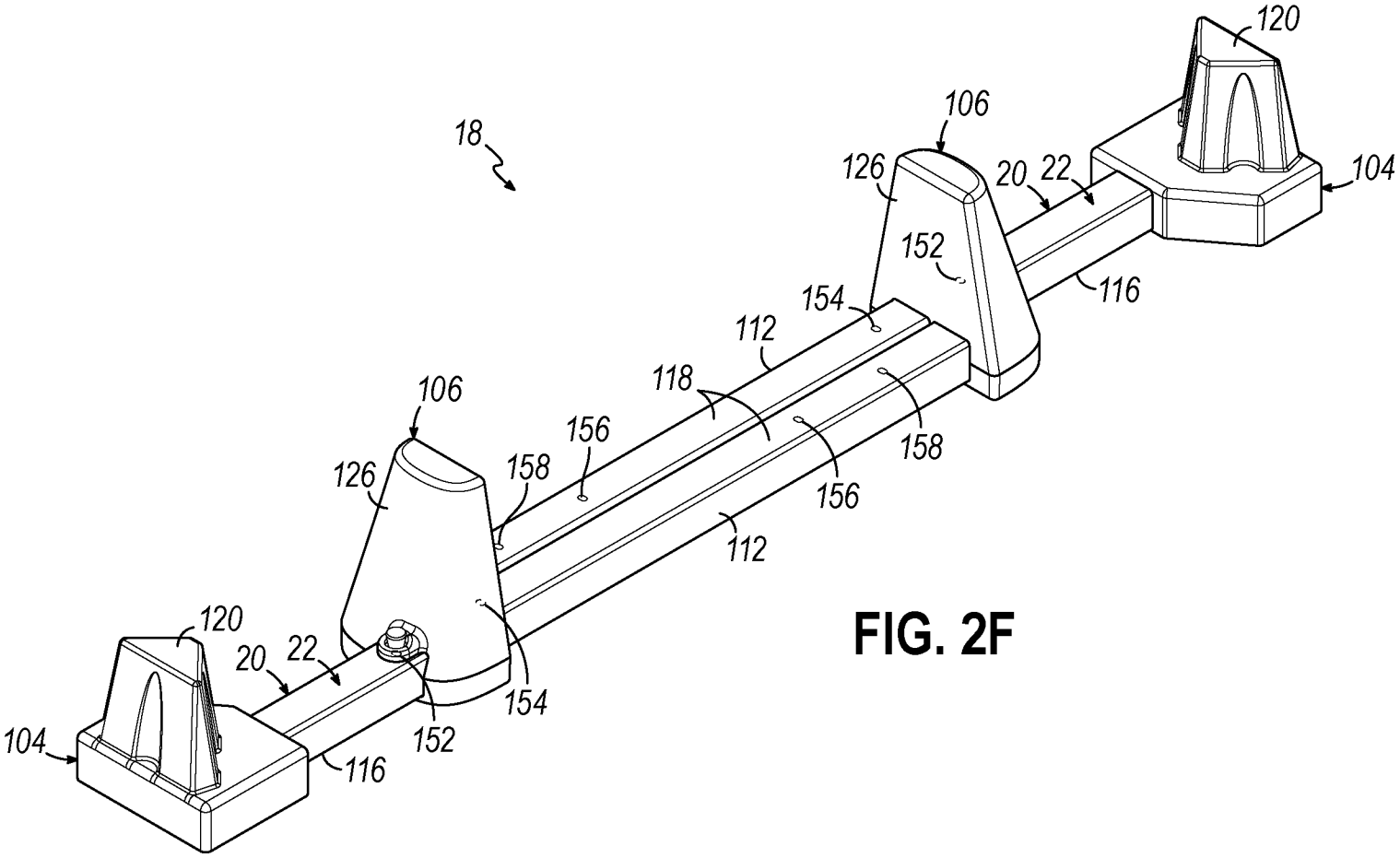
FIG. 2F is an enlarged perspective view of the cross rail assembly of FIG. 2D showing its bottom surface.

As shown in FIGS. 2D and 2F, each of the cross rail assemblies 18 comprises two identical cross rails 20 movable relative to each other. One of the cross rails 20 is shown in detail in FIGS. 2E and 2G. Referring to FIG. 2E, each cross rail 20 comprises a straight or middle member 22, an end member 104 and an inner leg assembly 106. The straight or middle unitary member 22 comprises a top wall 116, a bottom wall 118 and two side walls 112 defining a hollow interior 110. The middle member 22 is preferably made of steel, but may be made of other known material. Two hole sets 114 are located at each end of the straight or middle member 22, each hole set 114 comprising a hole extending through a top wall 116 of the straight or middle member 22, and a second aligned hole extending through a bottom wall 118 of the straight or middle member 22.

As best shown in FIG. 2E, the end member 104 of each cross rail 22 comprises a unitary piece having a projection 120 and a receptacle 121. The projection 120 is shaped and sized to fit inside one of the cavities 84, 84*a* of one of the leg assemblies 32, 86, respectively, without the use of any tools. The receptacle 121 of each end member 104 of each cross rail 22 is sized to receive an outer end portion of the straight or middle member 22 of each cross rail 20. As best shown in FIG. 2E, a fastener 122 extends through each of the two hole sets 114 and is secured into an opening (not shown) in the end member 104 to secure the straight or middle member 22 to the end member 104.

As best shown in FIG. 2E, the inner leg assembly 106 of each cross rail 22 comprises an inner leg 126, a cover 128 and a locking pin assembly 130. The inner leg 126 is preferably a unitary member having a receptacle 131, a passage 132 and four threaded openings 134. The receptacle 131 is sized to receive an outer end portion of the straight or middle member 22 of each cross rail 20, such that the cross rail 20 has a fixed length. As best shown in FIG. 2E, a fastener 122 extends through each hole set 114 and is secured into an opening 146 (shown in FIG. 2G) in the receptacle 131 of the inner leg 126 to secure the straight or middle member 22 to the inner leg 126. As best shown in FIG. 2E, four fasteners 136 extends through holes 138 in cover 128 and are secured into openings 134 in the inner leg 126 to secure the cover 128 to the inner leg 126. Lastly, the passage 132 has an outer opening 140 adapted to receive a spring-loaded locking pin assembly 130.

Figure 2G:
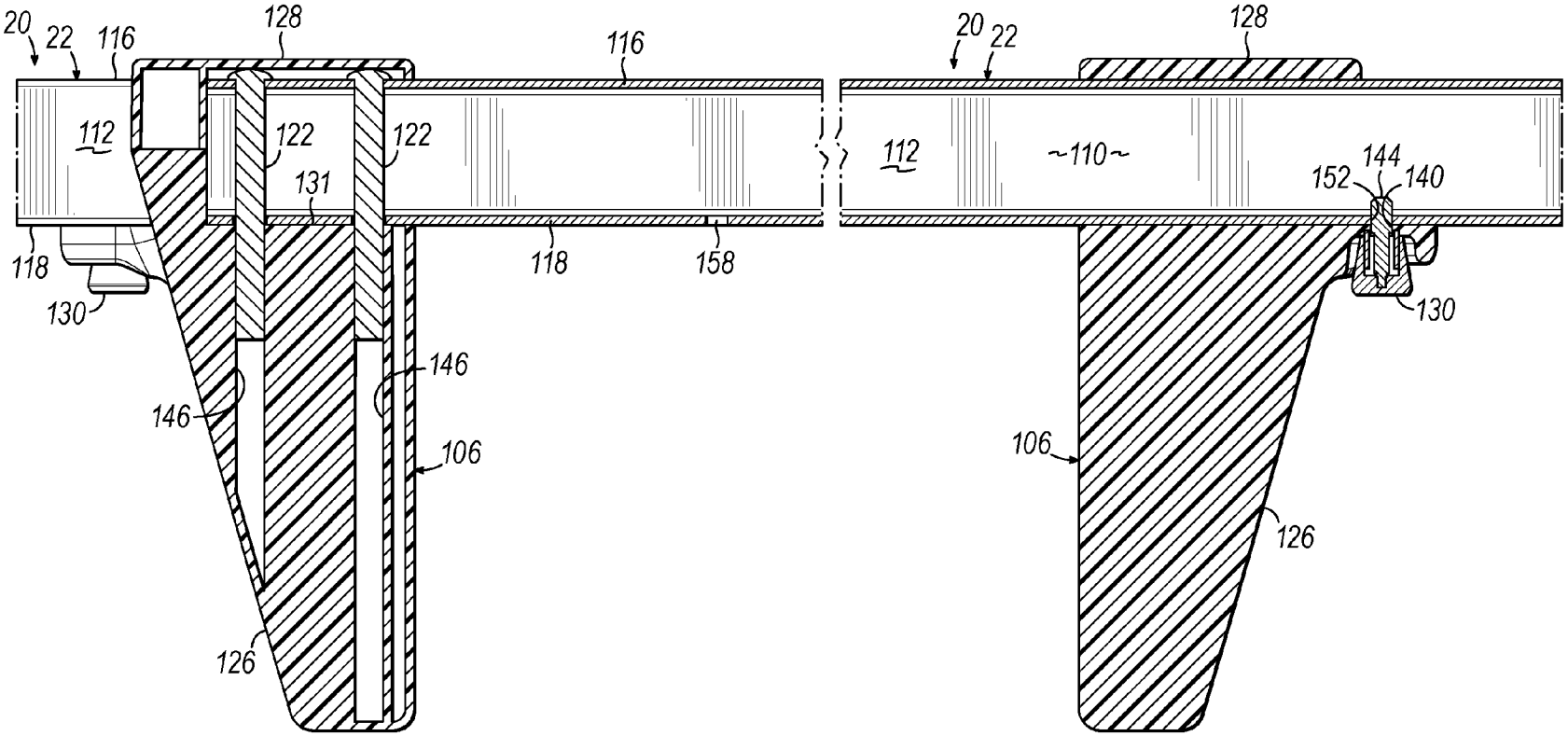
FIG. 2G is cross-sectional view of the cross rail assembly of FIG. 2D taken along the line 2G-2G of FIG. 2D.

As shown in FIG. 2F, each cross rail 20 is movable relative to the other cross rail 20. However, the cross rail assembly 18 may be fixed in one of four predetermined lengths via use of the two locking pin assemblies 130, one per cross rail 20 as seen in FIG. 2G. The straight or middle member 22 of each cross rail 20 passes through the passage 132 of the inner leg assembly 106 of the other cross rail 20. Thus, each cross rail 20 may be locked in one of four positions relative to the adjacent cross rail 20 of one of the cross rail assemblies. Although the drawings and description show four predetermined locking positions, any number of locking positions may be incorporated into a cross rail assembly.

Figure 6:
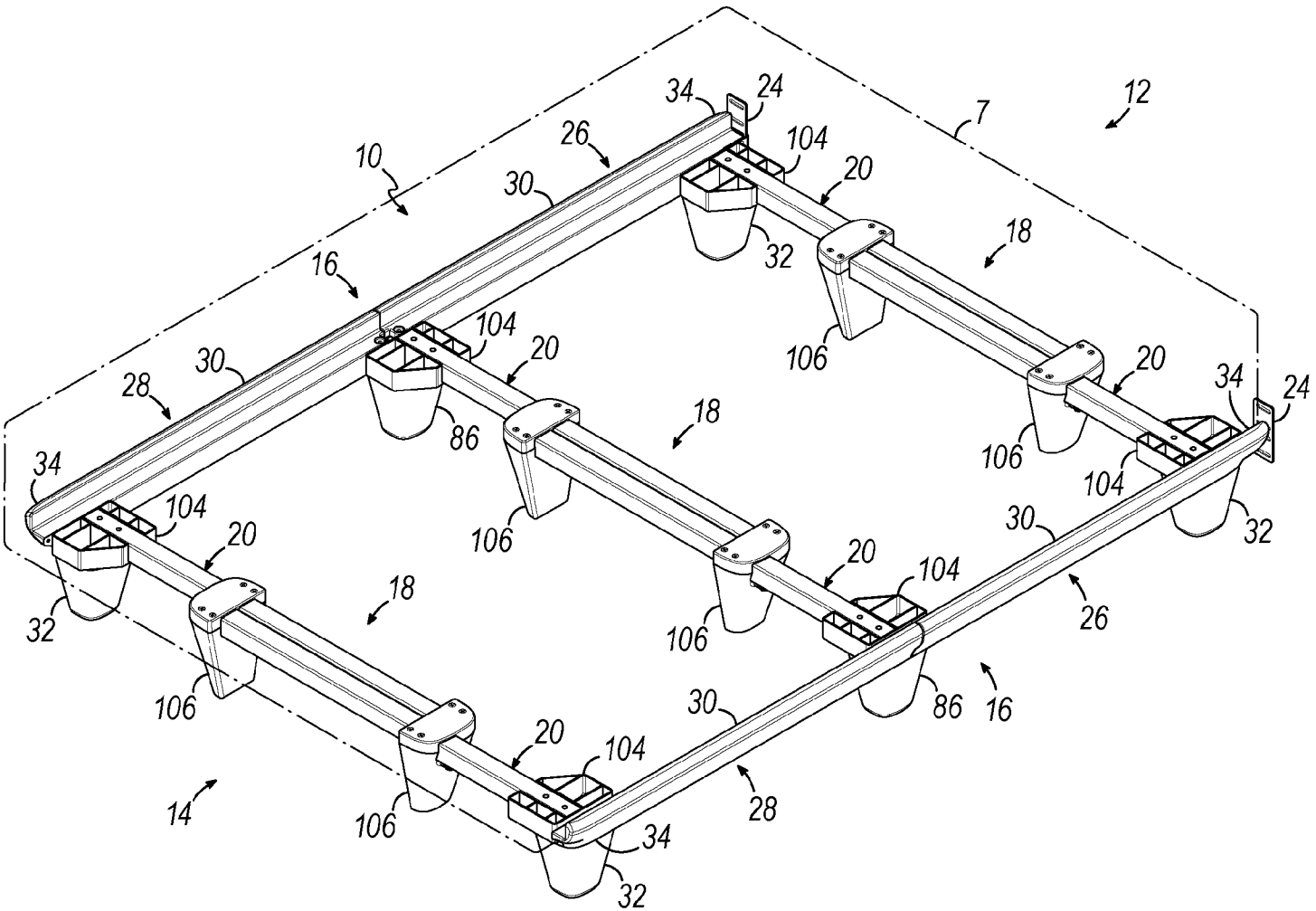
FIG. 6 is a perspective view of the bed frame assembly showing all three cross rail assemblies at their shortest length and locked to fit a full size box spring.

As shown in FIG. 2F, an underside of the straight or middle member 22 of each cross rail 20 has four openings 152, 154, 156 and 158. Each opening 152, 154, 156 and 158 is adapted to receive a spring loaded pin 144 of the locking pin assembly 130 of the other cross rail 20. FIG. 2F shows one of the cross rail assemblies 18 being locked in its narrowest locked position in which the locking pin 144 of each cross rail 20 is located in the outermost opening 152 (closest to the end member 104) of the other cross rail 20. In this locked position, the bed frame assembly 10 is adapted to receive a full size box spring, as shown in FIG. 6. As shown in FIG. 2F, in this position, the inner leg assemblies 106 of the two cross rails 20 of one of the cross rail assemblies 18 are closer together than they are in the other three locked positions and a greater length of each middle member 22 of each cross rail 20 lies adjacent the middle member 22 of the other cross rail 20.

In order to increase the length of the cross rail assembly 18, an operator pulls on the locking pin assemblies 130 to disengage the locking pins 144 from the openings 152. The end members 104 of the cross rail 20 are then moved away from each other to increase the length of the cross rail assembly 18. If the bed frame assembly 10 is for a queen size box spring, then the locking pins 144 are allowed to engage the next outermost openings 154 (closer to the inner leg assembly 106 of each cross rail 20). If the bed frame assembly 10 is for a California king size box spring, then the locking pins 144 are allowed to engage the second innermost openings 156. If the bed frame assembly 10 is to be locked to fit a king size box spring, then the locking pins 144 are allowed to engage the openings 158 (closest to the inner leg assembly 106 of each cross rail 20). In this manner, the length of the cross rail assemblies 18 can be locked in one of four predetermined lengths. One may adjust the length of a cross rail assembly 18 simply by pulling on the locking pin assemblies 130 of both cross rails 20, such that the locking pins 144 disengage from corresponding openings of the cross rails 20. See FIG. 2G. It is within the contemplation of the present invention that only one of the cross rails 20 has a spring-loaded locking pin assembly 130 for purposes of locking the cross rails 20 of one of the cross rail assemblies 18 in a desired location.

Figure 3:
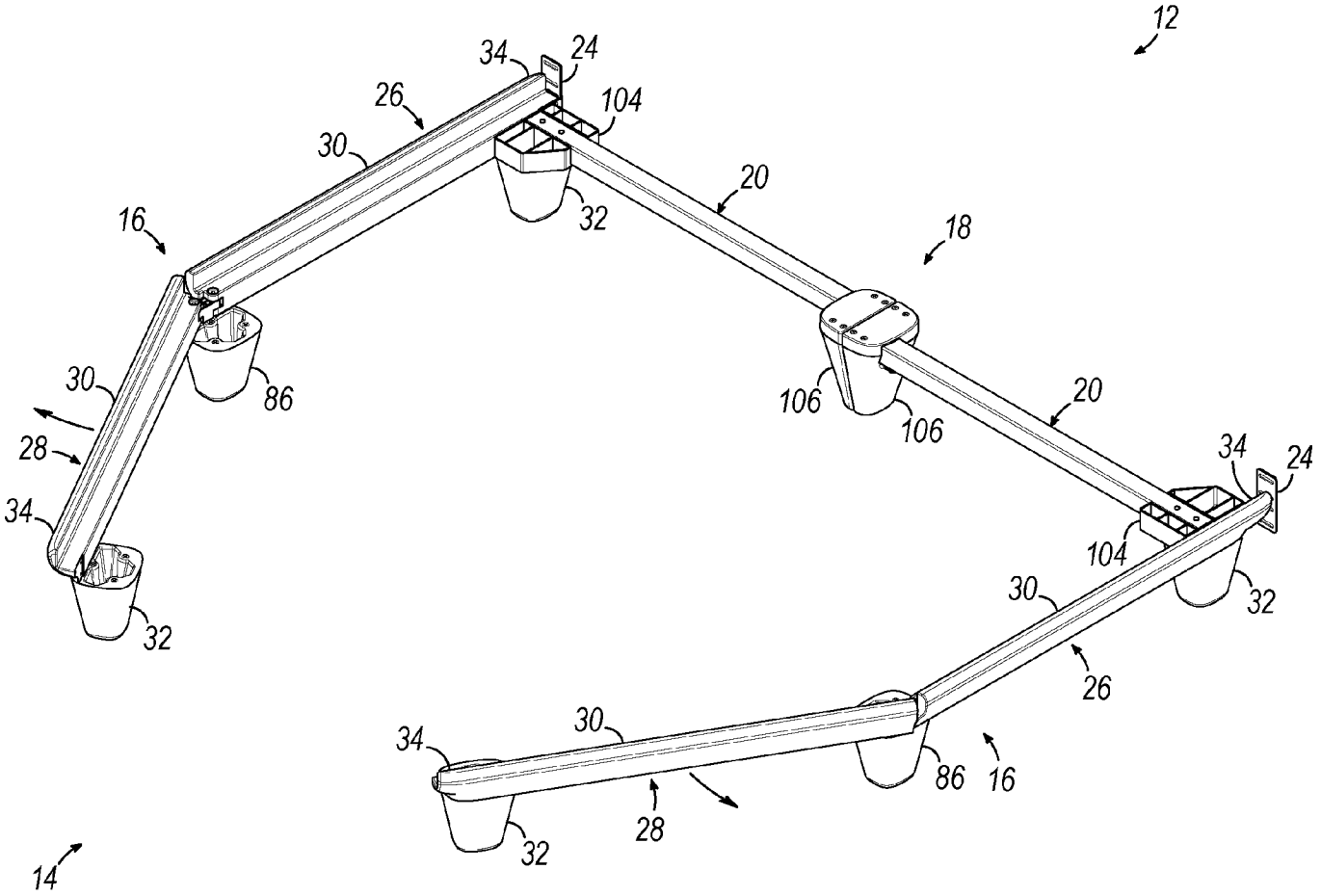
FIG. 3 is a partially disassembled view of a portion the bed frame assembly of FIG. 5 showing the side rail assemblies being straightened and one cross rail assembly being fully extended and engaged with the side rail assemblies.
Figure 3B:
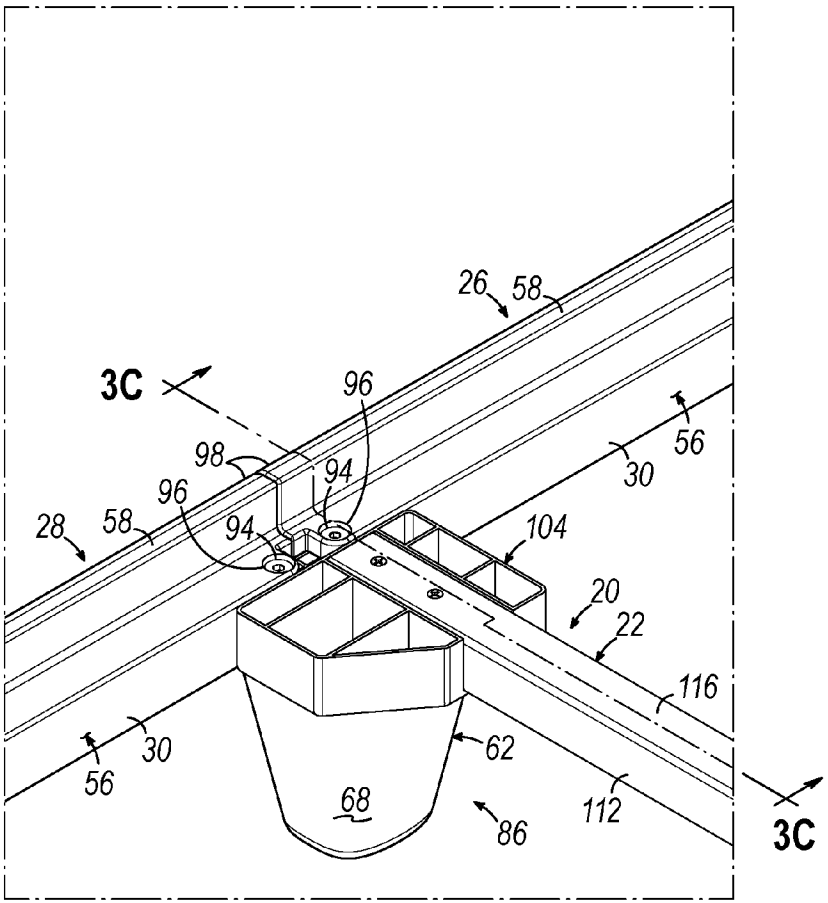
FIG. 3B is an enlarged view showing one end of the center cross rail assembly inside one of the center leg assemblies.
Figure 3A:
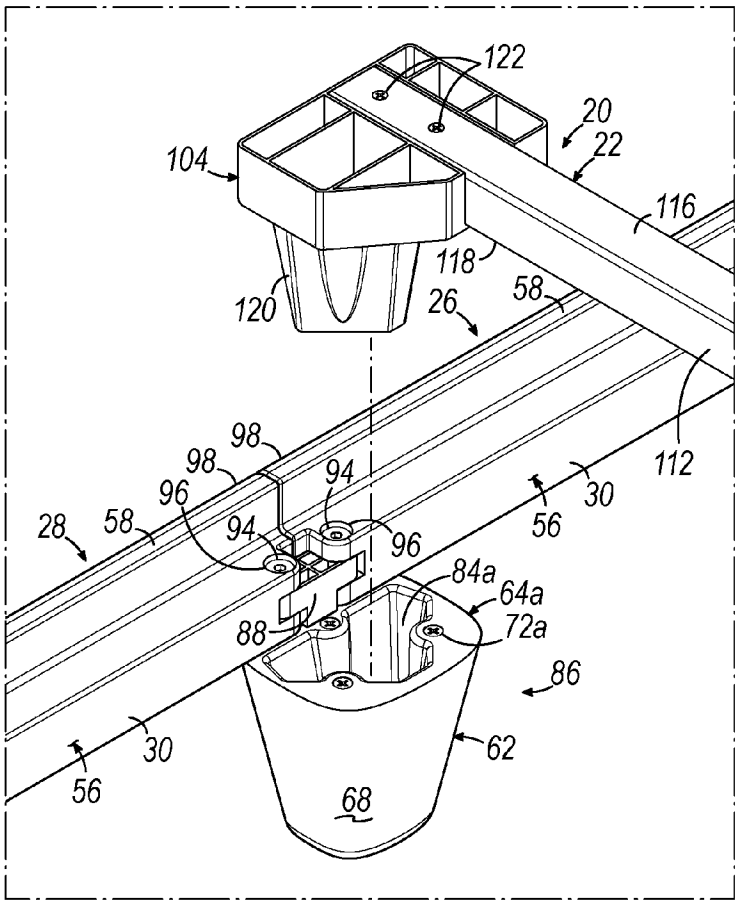
FIG. 3A is an enlarged view showing one end of the center cross rail assembly being inserted into one of the center leg assemblies.
Figure 3C:
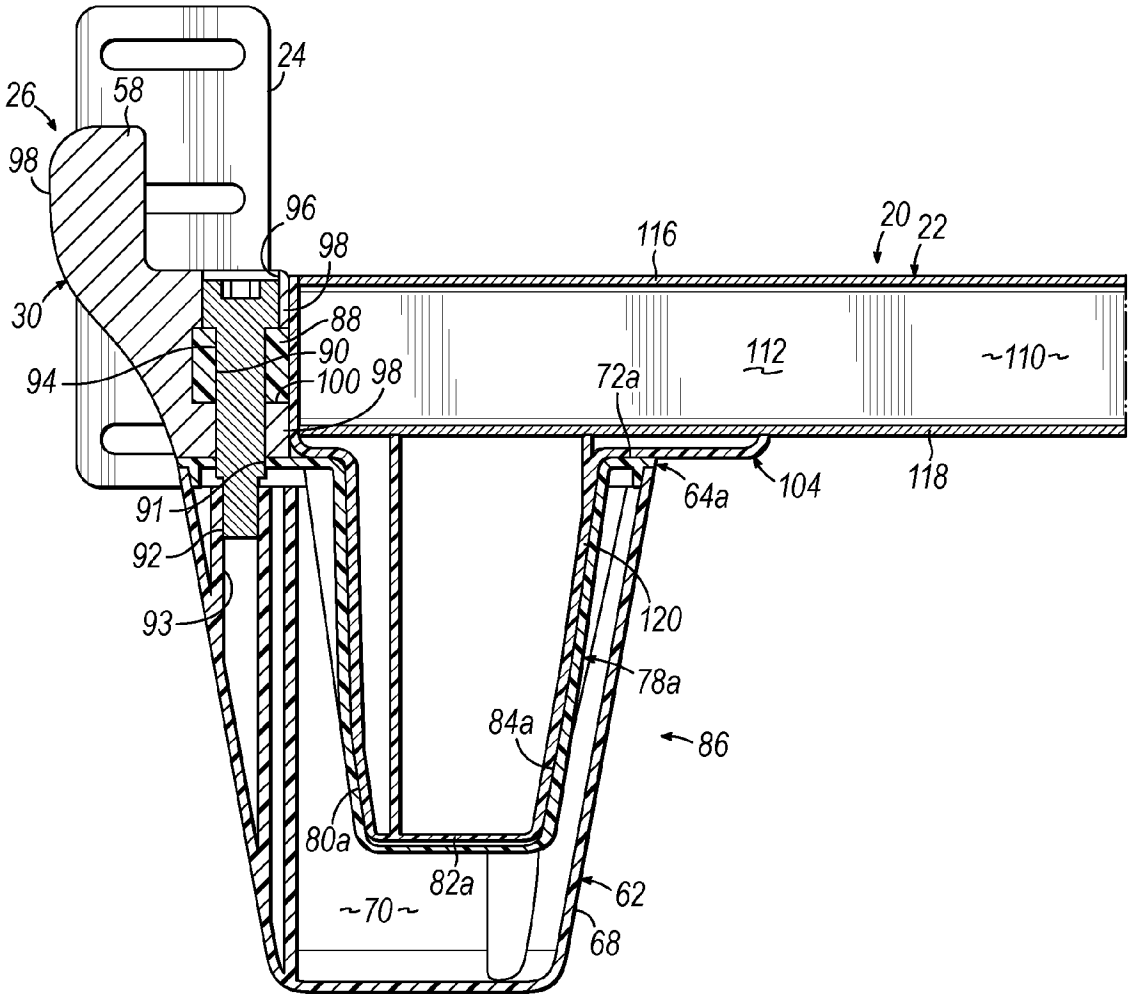
FIG. 3C is a cross-sectional view of a portion of the center cross rail assembly and side rail taken along the line 3C-3C of FIG. 3B.

FIG. 3 illustrates one of the cross rail assemblies 18 being engaged with the leg assemblies 32 of the head side rail sections 26 and extending therebetween. In this position, the projection 120 of the end member 104 of each cross rail 20 is located inside the cavity 84 of the molded plastic inner leg section 64 of the outer leg assembly 32 of each side rail assembly 16. FIGS. 3A, 3B and 3C illustrate the method of securing the middle or center cross rail assembly 18 to the center leg assemblies 86.

Figure 4:
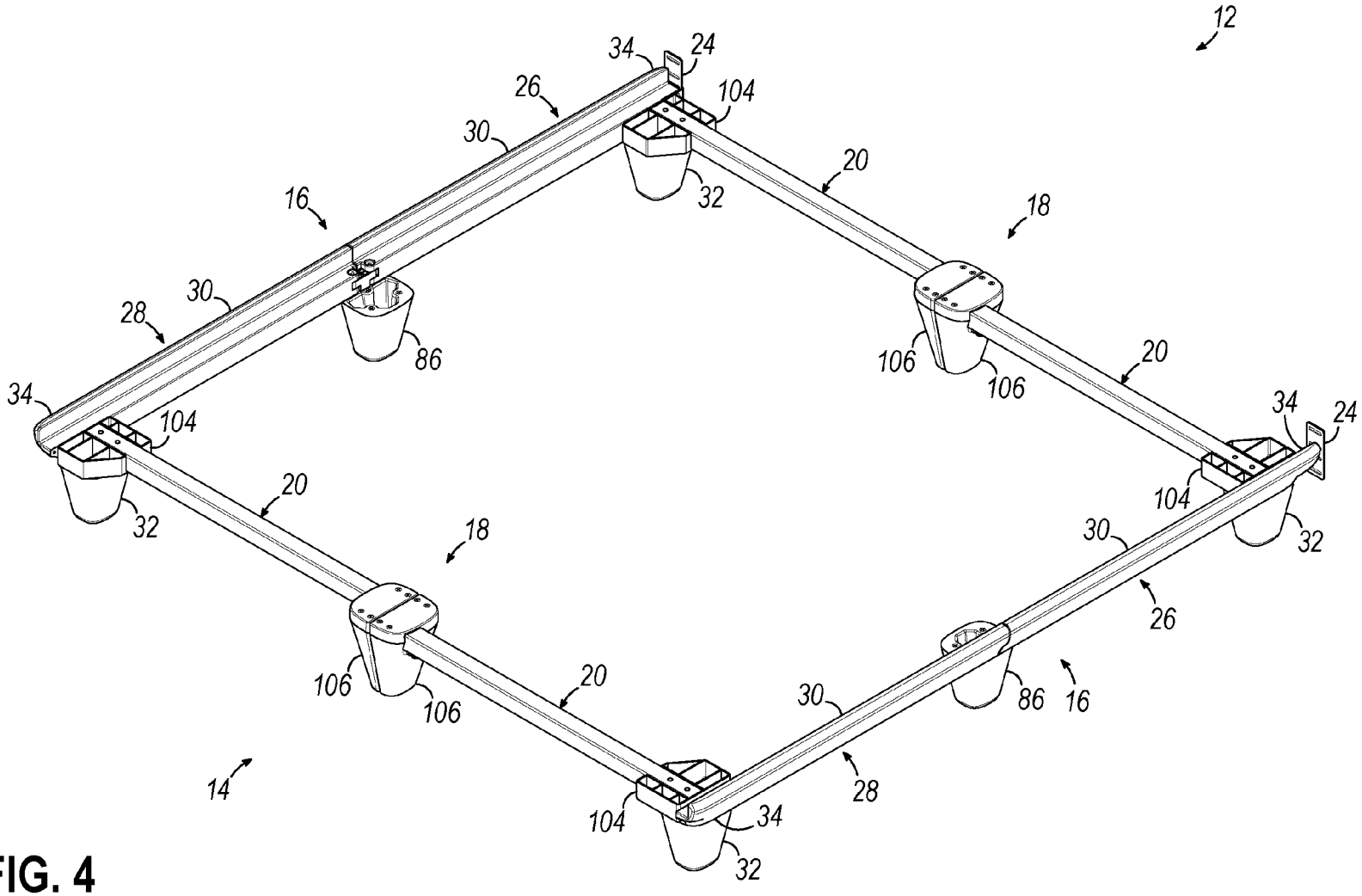
FIG. 4 is a perspective view of a portion of the bed frame assembly of FIG. 5 without the center cross rail assembly, the outer cross rail assemblies being fully extended and locked to fit a king size box spring.

FIG. 4 illustrates the first and third cross rail assemblies 18, each extending between outer leg assemblies 32 at the head and foot ends of the bed frame assembly 10. In FIG. 4, the first and third cross rail assemblies 18 are in a fully extended position adapted to receive a king size box spring 5. When a cross rail assembly 18 is locked in the fully extended or expanded position, as shown in FIGS. 4 and 5, the inner leg assembly 106 of one cross rail 20 abuts the inner leg assembly 106 of the other cross rail 20. FIG. 5 illustrates all three cross rail assemblies 18 extending between leg assemblies 32, 86 of the bed frame assembly 10. In FIG. 5, each cross rail assembly 18 is in a fully extended position adapted to receive a king size box spring 5. FIG. 6 illustrates each cross rail assembly 18 in its shortest locked position adapted to receive a full size box spring 7. As shown in FIG. 6, when a cross rail assembly 18 is locked in the shortest locked position, the inner leg assembly 106 of one cross rail 20 is spaced from the inner leg assembly 106 of the other cross rail 20.

Figure 7C:
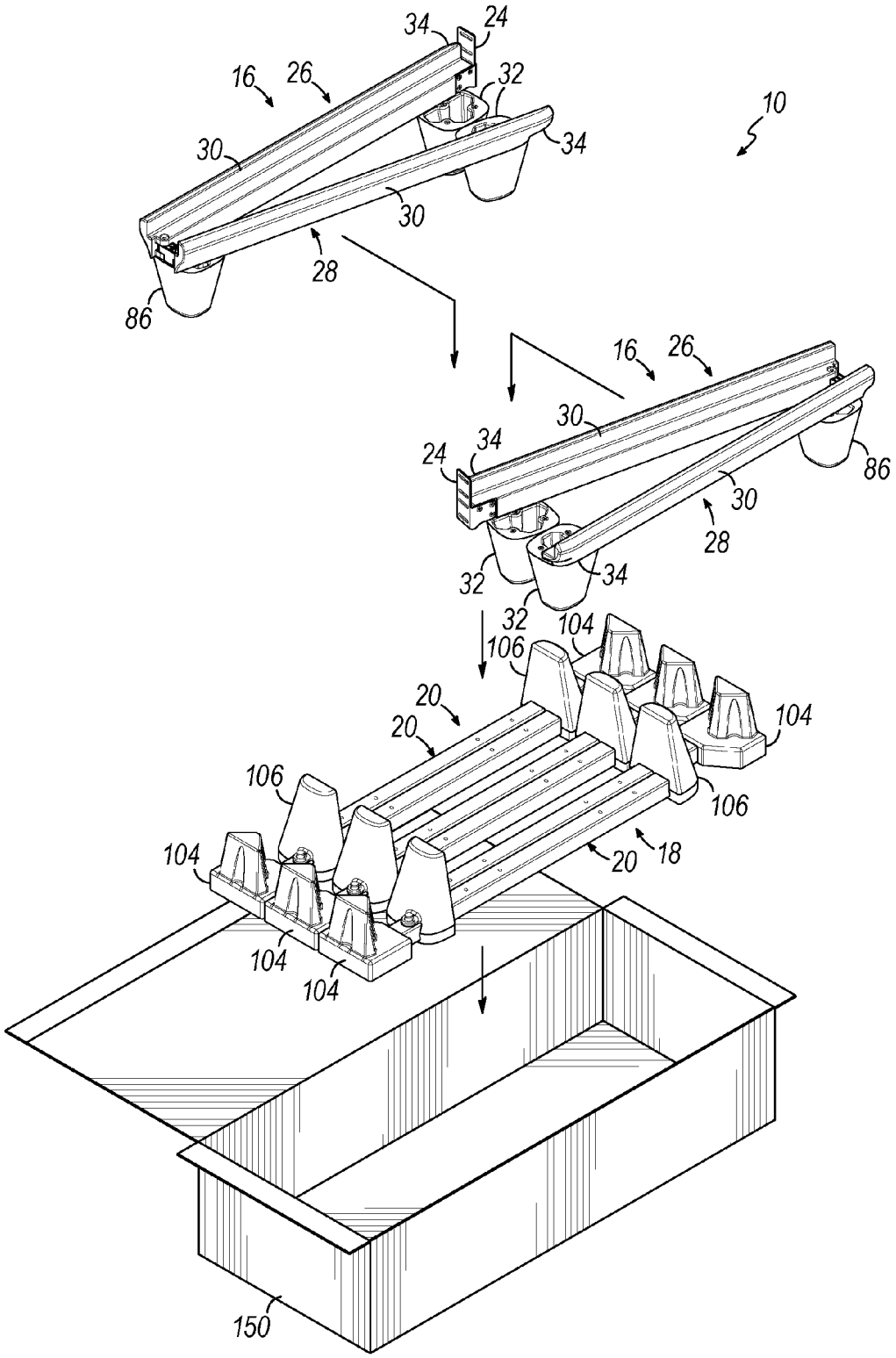
FIG. 7C is a perspective view of the bed frame assembly being inserted in a shipping container.
Figure 7D:
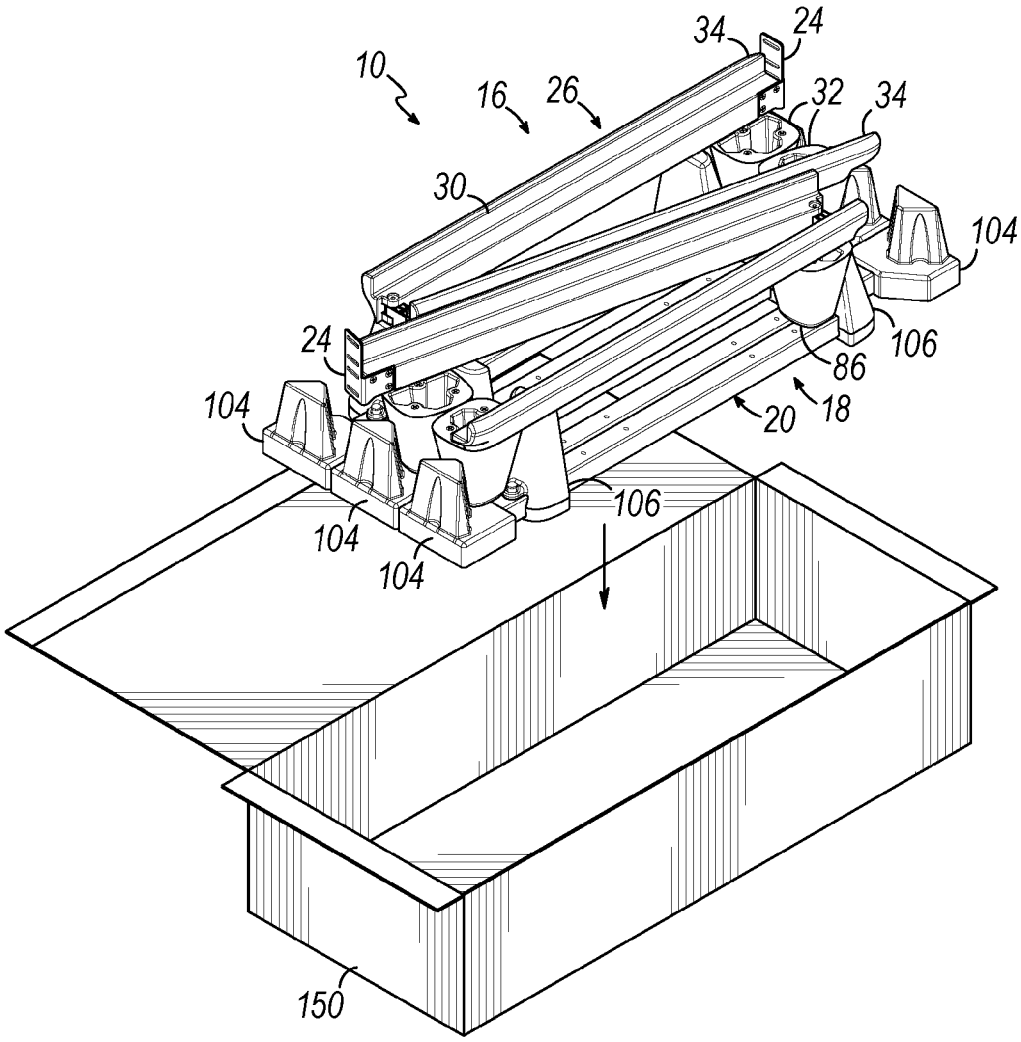
FIG. 7D is a perspective view of the bed frame assembly being further inserted in a shipping container.
Figure 7E:
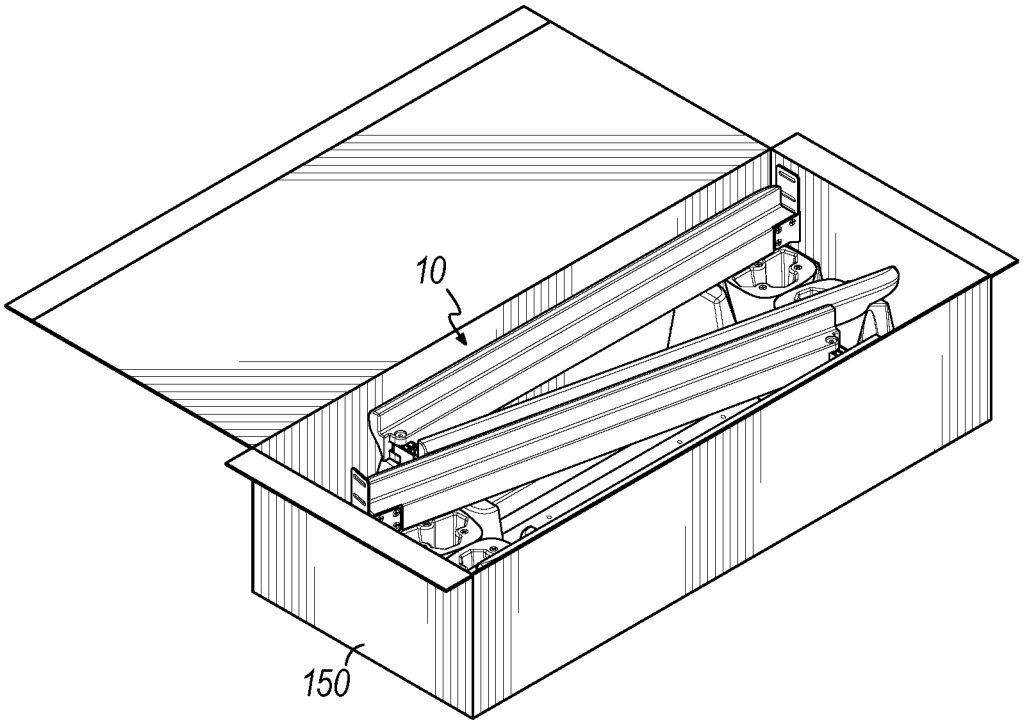
FIG. 7E is a perspective view of the bed frame assembly inside the shipping container.

FIGS. 7A-7E show the method of disassembling the bed frame assembly 10 without the use of any tools. FIG. 7A illustrates one of the side rail assemblies 16 in a straightened position. FIG. 7B shows the same side rail assembly 16 in a collapsed position for shipping or storage. FIG. 7C shows each side rail assembly 16 in a collapsed position and each cross rail assembly 18 in a fully shortened or collapsed position. When a cross rail assembly 18 is in the fully shortened or collapsed position, as shown in FIGS. 7C and 7D, the inner leg assembly 106 of one cross rail 20 abuts the end member 104 of the other cross rail 20, and the cross rail assembly is not locked in any position. In other words, each cross rail 20 is able to move relative to the other cross rail 20 because the locking pin 44 is not in one of the four openings 142 shown in FIGS. 2F and 2G. FIG. 7D shows all five components of the bed frame assembly 10 being inserted into a box 150 for shipping. FIG. 7E shows the bed frame assembly 10 inside the interior of box 150.

Although the legs are shown having a certain size and shape, any of them may be other sizes or shapes. Similarly, the mounting brackets may be any desired shapes or sizes. Although we have described one preferred embodiment of the invention, we do not intend to be limited except by the scope of the following claims.

We claim:

1. A bed frame assembly comprising:

a pair of collapsible side rail assemblies, each of the collapsible side rail assemblies comprising a center leg assembly and two side rail sections, the center leg assembly comprising a molded plastic outer leg section and a molded plastic inner leg section, the molded plastic inner leg section having a generally T-shaped bucket extending downwardly from an upper lip, a hollow interior cavity and a generally T-shaped connector having openings, the generally T-shaped bucket of the molded plastic inner leg section fitting into a receptacle of the molded plastic outer leg section, the molded plastic inner and outer leg sections being secured together with fasteners extending through the upper lip of the molded plastic inner leg section and into threaded openings in the molded plastic outer leg section, each side rail section having an end portion comprising two lips with a gap therebetween, a portion of the generally T-shaped connector of the center leg assembly fitting inside each of the gaps of each of the end portions of each of the side rail sections, each of the lips of each of the end portions of each of the side rail sections having an opening therethrough, each side rail section being pivotally secured to the center leg assembly such that each of the side rail sections is pivotal relative to the center leg assembly about a pivot axis defined by a fastener extending through each of the lips of the side rail section and through an associated one of the openings in the T-shaped connector of the center leg assembly;

an outer leg assembly secured to an end of each side rail section, each outer leg assembly having a hollow interior cavity therein;

multiple cross rail assemblies extending between the side rail assemblies, each cross rail assembly comprising two cross rails movable relative to each other to adjust the cross rail assembly to one of multiple predetermined lengths wherein each of the cross rails has an end member sized to fit into one of the hollow interior cavities of one of the center and outer leg assemblies.

2. The bed frame assembly of claim 1 wherein each side rail section comprises a straight body portion comprising a hollow metal core at least partially covered with plastic.

3. The bed frame assembly of claim 2 wherein each leg assembly comprises multiple sections.

4. The bed frame assembly of claim 1 wherein the bed frame assembly comprises three cross rail assemblies.

5. The bed frame assembly of claim 1 wherein each cross rail assembly has at least one spring-loaded pin adapted to fit into openings of the cross rail assembly to fix the length of the cross rail assembly.

6. The bed frame assembly of claim 1 wherein each cross rail assembly has four predetermined lengths.

7. The bed frame assembly of claim 1 wherein each cross rail assembly has at least two predetermined lengths.

8. A collapsible bed frame assembly comprising:

two collapsible side rail assemblies, each of the side rail assemblies comprising a center leg assembly having a generally T-shaped connector and two side rail sections, each side rail section having an end portion comprising two lips with a gap therebetween, a portion of the generally T-shaped connector of the center leg assembly fitting inside the gap of the end portion of the side rail section, a fastener extending through each of the lips of the end portion of the side rail section, through the generally T-shaped connector of the center leg assembly and being received in a threaded opening in a molded plastic outer leg section of the center leg assembly, each fastener defining a pivot axis about which the side rail section pivots when the side rail assembly is collapsed, each side rail section further comprising a second end to which an outer leg assembly is secured, each outer and center leg assembly having a cavity therein;

multiple cross rail assemblies extending between the side rail assemblies, each cross rail assembly comprising two cross rails movable relative to each other to adjust the cross rail assembly to one of multiple predetermined lengths wherein each of the cross rails comprises a straight member, an end member secured to one end of the straight member and an inner leg secured to an opposed end of the straight member, a portion of the end member being sized to fit into one of the cavities of one of the outer and center leg assemblies.

9. The bed frame assembly of claim 8 wherein the bed frame assembly has three cross rail assemblies.

10. The bed frame assembly of claim 8 wherein each of the straight members of each of the cross rails comprises a metal core at least partially surrounded by plastic.

11. The bed frame assembly of claim 8 wherein each cross rail assembly has four predetermined lengths.

12. The bed frame assembly of claim 8 wherein each cross rail assembly has at least two predetermined lengths.

13. The bed frame assembly of claim 8 wherein the cavity of each leg assembly is generally T-shaped.

14. The bed frame assembly of claim 8 wherein each of the inner legs has a passage through which extends the straight member of the other cross rail of the cross rail assembly.

15. A collapsible bed frame assembly comprising:

two side rail assemblies, each of the side rail assemblies comprising a center leg assembly and two side rail sections, the center leg assembly comprising a molded plastic outer leg section and a molded plastic inner leg section, the molded plastic inner leg section having a bucket extending downwardly from an upper lip, a hollow interior cavity and a generally T-shaped connector located above the upper lip of the molded plastic inner leg section, the bucket of the molded plastic inner leg section fitting into a receptacle of the molded plastic outer leg section, the molded plastic inner and outer leg sections being secured together, each side rail section having an end portion comprising two lips with a gap therebetween, a portion of the generally T-shaped connector of the center leg assembly fitting inside the gap of the end portion of the side rail section, a fastener extending through each of the lips of the end portion of the side rail section, through the portion of the generally T-shaped connector of the center leg assembly inside the gap of the end portion of the side rail section and being received in a threaded opening in the molded plastic outer leg section of the center leg assembly, each fastener defining a pivot axis about which the side rail section pivots when the side rail assembly is collapsed, each side rail section further comprising an outer leg assembly, each outer leg assembly of each side rail section having a cavity therein;

multiple cross rail assemblies extending between the side rail assemblies, each cross rail assembly comprising two cross rails movable relative to each other to adjust the cross rail assembly to one of multiple predetermined lengths wherein each of the cross rails comprises an end member having a projection sized to fit into one of the cavities of one of the leg assemblies and an inner leg wherein a portion of each cross member passes through the inner leg of the other cross member.

16. The bed frame assembly of claim 15 wherein each of the cross rails further comprises a middle member extending between the end member and the inner leg.

17. The bed frame assembly of claim 16 wherein the middle member comprises a hollow metal core at least partially surrounded by plastic.

18. The bed frame assembly of claim 15 wherein each cross rail assembly has four predetermined lengths.

19. The bed frame assembly of claim 15 wherein the bed frame assembly has three cross rail assemblies.

20. The bed frame assembly of claim 16 wherein the middle member is a straight metal member surrounded by plastic.

* * * * *